United States Patent [19]

Grange

[11] 3,972,164

[45] Aug. 3, 1976

[54] ROOF CONSTRUCTION WITH INLET AND OUTLET VENTING MEANS

[76] Inventor: Howard L. Grange, P.O. Box E, Darlington, Wis. 53530

[22] Filed: Mar. 11, 1974

[21] Appl. No.: 449,977

[52] U.S. Cl. ..... 52/95; 52/92; 52/199

[51] Int. Cl.[2] ..... E04B 7/18

[58] Field of Search ..... 52/92, 95, 199, 303; 98/DIG. 6

[56] References Cited

UNITED STATES PATENTS

| | | | |
|---|---|---|---|
| 2,333,219 | 11/1943 | Weeber | 52/95 |
| 2,477,152 | 7/1949 | Stevenson | 52/199 |
| 2,969,726 | 1/1961 | Bottom | 98/DIG. 6 |
| 2,986,904 | 6/1961 | Williamson | 98/DIG. 6 |
| 3,160,987 | 12/1964 | Pinkley | 52/95 |
| 3,423,889 | 1/1969 | Elconin | 52/58 |
| 3,683,785 | 8/1972 | Grange | 98/DIG. 6 |
| 3,748,803 | 7/1973 | Widerby | 52/199 |
| 3,797,180 | 3/1974 | Grange | 52/95 |
| 3,863,553 | 2/1975 | Koontz | 52/95 |

FOREIGN PATENTS OR APPLICATIONS

| | | | |
|---|---|---|---|
| 224,322 | 11/1962 | Austria | 52/303 |

*Primary Examiner*—Ernest R. Purser
*Assistant Examiner*—Leslie A. Braun
*Attorney, Agent, or Firm*—Andrus, Sceales, Starke & Sawall

[57] ABSTRACT

A roof construction for providing a flow of air along the underside of the roof deck to prevent ice formations on the roof. An insulating member is positioned between adjacent rafters in the roof and includes a lower surface that rests on the ceiling and an upper inclined surface which bears against the roof deck. The upper surface is provided with a series of grooves that define air passages for the flow of air upwardly along the underside of the roof deck so that air can flow freely from the facia to the ridge of the roof. The outer edge of the insulating member can be provided with a downwardly extending lip that engages the outer surface of the exterior wall to position the insulating member between the rafters.

6 Claims, 6 Drawing Figures

ROOF CONSTRUCTION WITH INLET AND OUTLET VENTING MEANS

BACKGROUND OF THE INVENTION

In northern climates, and particularly in locations where there is intermitent freezing and thawing, snow which accumulates on the roof will melt and flow downwardly along the roof toward the eaves or overhang where the attic heat is no longer present to assist melting. Due to the thermal drop in the area of the eaves, the melted snow freezes to form ice packs that block further run off and act as dams so that subsequently melted snow will seep under the shingles and through nail holes or sheathing cracks. The seeping water can cause staining or discoloration of the ceiling and walls of the building.

The formation of ice packs at the eaves can be prevented by eliminating the thermal gradient and providing a free flow of air from the eaves to the ridge of the roof. It has been found that the key region where ventilation and thermal protection is most critical is the restricted vertical clearance between the top of the plate of the vertical wall and the roof deck. In normal building construction, the ceiling joists and rafters are nailed to the top plate of the vertical wall and usually a heel cut in the rafters reduces the vertical clearance between the top plate and the roof deck to as little as an inch or two.

Furthermore, the ceiling of the building is normally insulated by use of either blown insulation or insulation batts and very often the insulation is stuffed or blown into this restricted vertical clearance between the top plate and the roof deck, thus reducing or entirely eliminating the free flow of air along the underside of the roof deck. On the other hand, if full insulation is not carried through along the ceiling to the top plate, the area of the ceiling adjacent the top plate will be inadequately insulated, resulting in cold spots and possible condensation on the ceiling.

U.S. Pat. No. 3,683,785, is directed to a roof construction utilizing baffles which are located between adjacent rafters and are spaced from the undersurface of the roof deck to define air channels that extend from the facia to a location inwardly of the exterior wall of the building.

The U.S. patent application Ser. No. 272,380 filed July 17, 1972 now U.S. Pat. No. 3,797,180 patented Mar. 19, 1974 also discloses a construction for providing air flow along the underside of the roof. In that application a sheet of corrugated material is nailed to the upper surface of the rafters before applying the roof deck, with the sheet material bridging the top plate of the exterior wall. The corrugated sheet material, in combination with the roof deck, defines channels for the flow of air along the undersurface of the roof deck.

SUMMARY OF THE INVENTION

The invention relates to an improved ventilated roof construction for eliminating the thermal gradient on the underside of the roof deck while also providing adequate insulation in the area of the ceiling adjacent the top plate of the exterior wall. In accordance with the invention, an insulating member, formed of foam plastic or the like, is positioned between adjacent rafters of the roof, and the insulating member includes a lower surface that rests on the ceiling and an inclined upper surface which bears against the undersurface of the roof deck. The upper surface of the insulating member is formed with a series of grooves or recesses that in combination with the roof deck define air passages for the flow of air along the undersurface of the roof deck from the facia to the ridge.

To facilitate the positioning of the insulating members, the outer edge of the insulating member can be provided with a downwardly extending lip or flange which engages the outer surface of the top plate.

The insulating members of the invention not only insure free air flow along the underside of the roof deck from the eaves to the ridge, including within the critical vertical clearance between the top plate and the roof deck, to prevent ice dam formation but also provide adequate insulation in the region of the ceiling adjacent the top plate, thereby eliminating cold spots, and possible condensation, on the ceiling.

Other objects and advantages will appear in the course of the following description.

DESCRIPTION OF THE DRAWINGS

The drawings illustrate the best mode presently contemplated of carrying out the invention.

In the drawings.

DESCRIPTION OF THE PREFERRED EMBODIMENT

Figure 1:
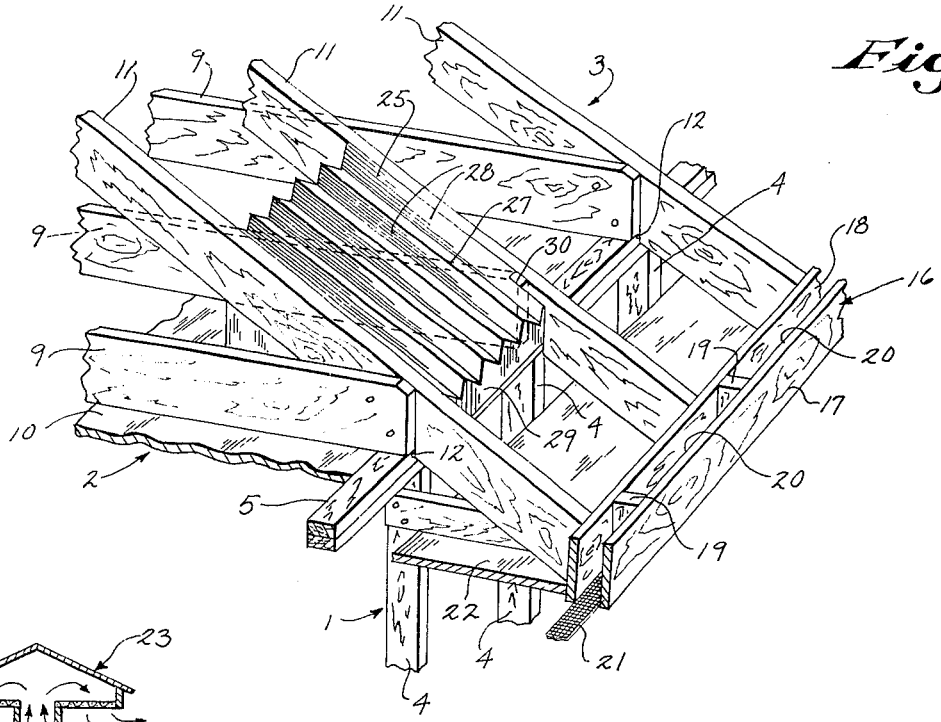
FIG. 1 is a perspective view of a roof construction incorporating the ventilating system of the invention.
Figure 2:
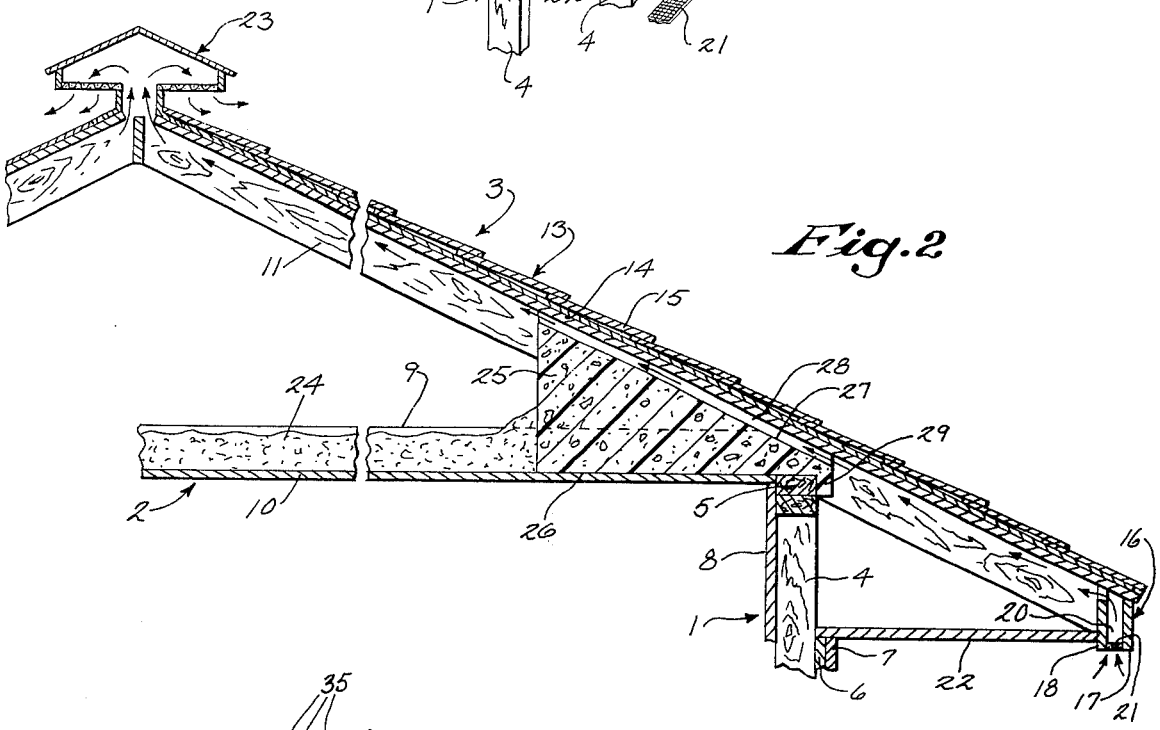
FIG. 2 is a side elevation of the structure shown in FIG. 1.

FIGS. 1 and 2 illustrate a typical building construction which includes an exterior wall 1, a ceiling 2 and a roof 3.

The wall 1 is composed of a series of vertical studs 4 and a top plate 5 is connected to the upper ends of the studs. Outer sheathing 6 is applied to the outer surfaces of the studs and a layer of siding 7 can be applied to the sheathing 6. Sheets of plaster board 8 or the like are attached to the inner surface of the studs 4 and insulation, not shown, can be applied between the studs.

The ceiling 2 is composed of a series of parallel, ceiling joists 9 which rest on the top plate 5. A layer of plaster board 10, or the like is attached to the undersurface of the joists 9.

The roof 3 includes a series of rafters 11, with each rafter having a notch or heel cut 12 which rests on the upper plate 5 adjacent the respective ceiling joist 9. The rafters support a roof deck 13 which is composed of a layer of sheathing or plywood 14 covered with an outer layer of shingles 15.

A facia 16 is secured to the outer ends of the rafters 11 and includes an outer member 17 and an inner member 18 which are spaced apart by spacers 19. The spaces between the spacers 19 provide inlet passages 20 for air, and the lower ends of the spaces 20 are closed off by a screen 21. A soffit 22 extends between the ends of the rafters 11 and the wall 1.

Air which enters the attic area beneath the roof deck 13 through the inlet passages 20 is discharged through the outlet 23 at the ridge of the roof.

Insulating material 24 is the form of blown insulation or insulating batts is located between the ceiling joists 9 and rests on the plaster board 10.

According to the invention, a series of insulating members 25 are positioned between adjacent rafters and rest on the ceiling 2. Each insulating member 25 is provided with a lower surface 26 which rests on the ceiling plaster board 10 and an upper inclined surface 27 which bears against the underside of the roof deck 13. Grooves or flutes 28 are provided in the upper surface 27 and in combination with the roof deck, provide channels or passages for air passing along the undersurface of the roof deck from the air inlet 20 to the outlet 23.

The insulating members 25 can be rigid or flexible in nature, but if flexible, they should be capable of retaining their shape without collapsing. The members 25 can be formed of any type of insulation such as, foam rubber; foam plastic, such as polyurethene or polystyrene; bonded fibrous material, such as glass fibers, cellulose fibers or mineral fibers, and the like.

To position the insulating members 25 between the rafters 11, the outer end of each insulating member is provided with a downwardly extending lip or flange 29, which bears against the outer surface of the top plate 5, as shown in FIG. 2. In addition, if the insulating members 25 are formed of relatively rigid material the side of each insulating member 25 is provided with a notch 30 to accommodate the ceiling joist 9. On the other hand, if the members 25 are formed of flexible material the members can be formed to accommodate the ceiling joists.

With the construction, as shown in FIGS. 1 and 2, air enters the passages 20 in facia 16 and passes upwardly along the underside of the roof deck 13, through the grooves or flutes 28 in the insulating members 25. Thus, the insulating members 25 insure that the critical and restricted vertical space between top plate 5 and roof deck 13 is maintained open to the flow of air, and yet the insulating members 25 provides positive insulation for the area of the ceiling 2 adjacent the exterior wall.

Figure 4:
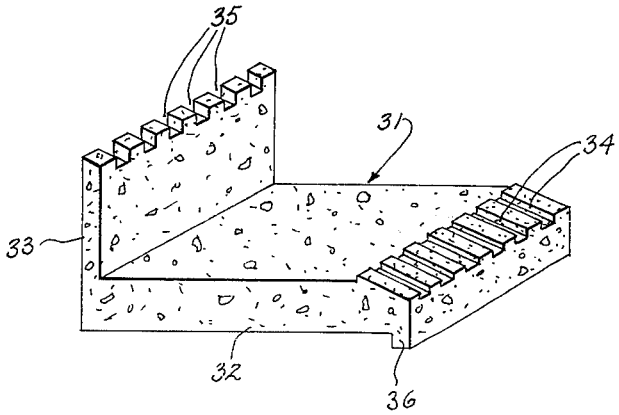
FIG. 4 is a perspective view of the insulating member as shown in FIG. 3.
Figure 3:
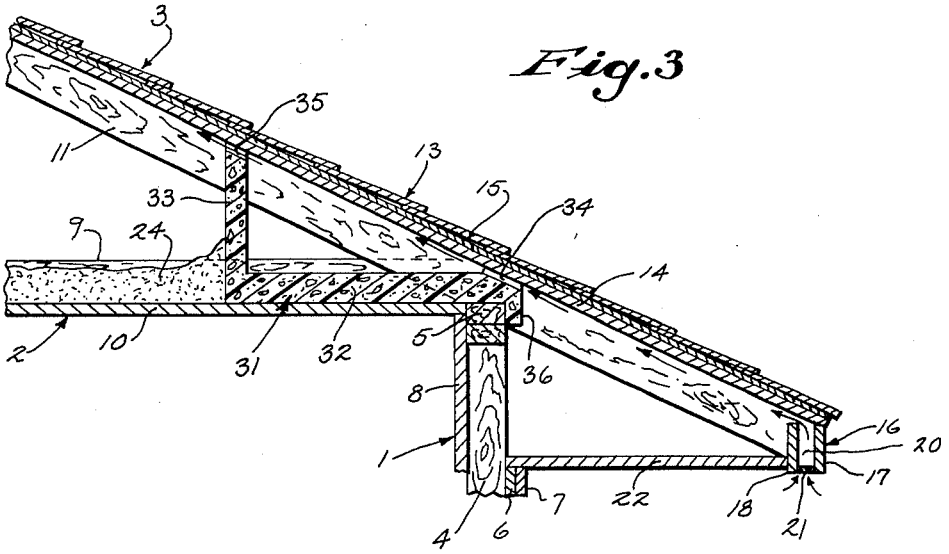
FIG. 3 is a side elevation similar to FIG. 2 of the modified form of the insulating member.

FIGS. 3 and 4 illustrate a modified form of the invention which the insulating members 31, similar to insulating member 25 of the first embodiment, are each provided with a lower section 32 and a vertical rear section 33. The forward inclined edge of section 32 is provided with a series of generally rectangular grooves or flutes 34 and the upper inclined edge of the rear section 33 is provided with similar grooves 35. The grooves 34 and 35 in combination with the lower surface of the roof deck 13 provide passages for the flow of air along the undersurface of the roof deck.

As in the case of the first embodiment, the insulating members 31 can each be provided with a downwardly extending lip 36 which engages the outer surface of the top plate 5 to position the insulating member between the rafters. In addition, the side edge of each insulating member, if formed of rigid material, can be notched to receive the respective ceiling joist 9.

The rear section 31 provides a stop to prevent the insulating material 24 between the ceiling joists 9 from being pushed or blown outwardly to a position where it could close off or clog the restricted vertical clearance between the top plate 5 and the undersurface of the roof deck 13.

Figure 5:
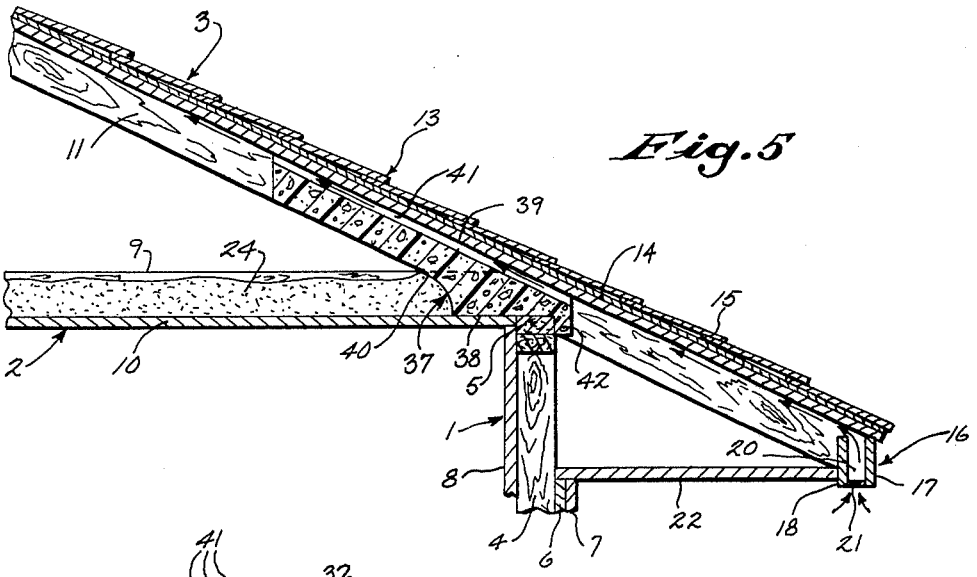
FIG. 5 is a side elevation, similar to FIG. 2, of a roof construction utilizing a further modified form of the insulating member.
Figure 6:
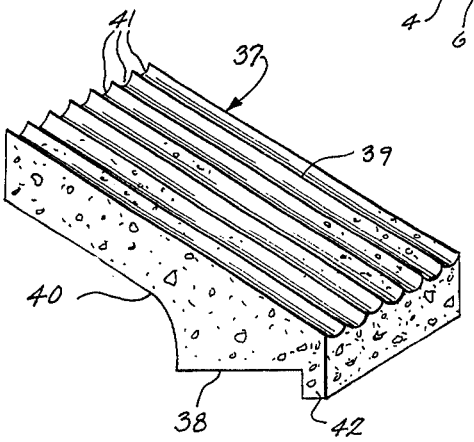
FIG. 6 is a perspective view of the insulating member as shown in FIG. 5.

FIGS. 5 and 6 illustrate a further modified form of the invention which includes a series of insulating members 37 located between the rafters 11. Each insulating member 37 includes a generally horizontal lower surface 38, that rests on the ceiling plaster board 10, and an inclined upper surface 39 that bears against the roof deck 13. The inner end of the insulating member 37 is provided with a curved recess 40, and the recess serves as a dam or stop to retain the insulating material 24.

As described with respect to the previous embodiments, the upper surface 39 is formed with a series of generally parallel, curved grooves or flutes 41 which, in combination with the lower surface of the roof deck 13, define air passages or channels for the flow of air.

The outer end of the insulating member can be provided with a downwardly extending lip 42 which bears against the top plate 5 and serves to position the insulating member between the rafters.

The insulating member 37 can be utilized when more expensive foam plastic materials are employed, for it reduces the amount of material required over that shown in FIG. 1.

The insulation members provide air channels through the restricted vertical space between the top plate and the undersurface of the roof deck, thereby insuring air flow from the inlets 20 to the outlet 23, as well as providing insulation for the ceiling in the critical area adjacent the top plate. Due to the fact that the inner ends of the air channels are located a substantial distance above the ceiling 2, the air channels cannot be blocked by the insulation 24.

The grooves or recesses in the insulating members can take any desired configuration, and in certain circumstances, the insulating members can be provided with elongated holes located adjacent the upper surface instead of the grooves.

Various modes of carrying out the invention are contemplated as being within the scope of the following claims particularly pointing out and distinctly claiming the subject matter which is regarded as the invention.

I claim:

1. A building construction, comprising an exterior vertical wall, a ceiling supported by the wall, a roof supported by the wall and including a series of spaced rafters and a roof deck supported by the rafters, air inlet means in the roof and disposed outwardly of the exterior wall, air outlet means in said roof and disposed inwardly of the exterior wall, insulating means supported by the ceiling, an insulating member located between adjacent rafters, each insulating member having a lower surface resting on the ceiling and having an upwardly and inwardly extending inclined upper surface bearing against the undersurface of the roof deck and having an inner end surface connecting the inner end of the lower surface and the inner end of said inclined surface, said insulating means abutting said inner end surface channel means in said member adjacent said upper surface and defining a series of channels for the flow of air along the undersurface of the roof deck in a direction from said air inlet means to the air outlet means, and flange means disposed on the outer end of said insulating member and extending downwardly from said lower surface, said flange means disposed in engagement with the outer surface of said exterior wall to position the insulating member longitudinally between said adjacent rafters.

2. The building construction of claim 1, wherein said insulating member is formed of foam plastic material.

3. The building construction of claim 1, wherein said channel means comprises a series of grooves disposed in said upper surface.

4. The building construction of claim 1, wherein the insulating member is formed of an insulating material having sufficient rigidity to maintain the position of said insulating member between the rafters and prevent sagging thereof.

5. The insulating member of claim 1, wherein said upper surface is provided with an inner section and a separate outer section, and said channel means is disposed in both said inner and outer sections.

6. A building construction, comprising an exterior vertical wall, a ceiling supported by the wall, a roof supported by the wall and including a series of spaced rafters and a roof deck supported by the rafters, air inlet means in the roof and disposed outwardly of the exterior wall, air outlet means in said roof and disposed inwardly of the exterior wall, an insulating member located between adjacent rafters, each insulating member having a lower surface resting on the ceiling and having an upwardly and inwardly extending inclined upper surface bearing against the undersurface of the roof deck, channel means in said insulating member adjacent said upper surface and defining a series of channels for the flow of air along the undersurface of the roof in a direction from said air inlet means to said air outlet means, and a flange disposed on the outer end of said insulating member and extending downwardly from said lower surface and disposed generally normal to said lower surface, said flange disposed in engagement with the outer surface of said exterior wall.

* * * * *